US007032972B2

(12) United States Patent
Berman et al.

(10) Patent No.: US 7,032,972 B2
(45) Date of Patent: Apr. 25, 2006

(54) RESILIENT SEATING STRUCTURE

(76) Inventors: Irwin R. Berman, 146 Shore Rush Dr., Saint Simons Island, GA (US) 31522; Frank H. Hambright, 556 Ocean Blvd., Saint Simons Island, GA (US) 31522

( * ) Notice: Subject to any disclaimer, the term of this patent is extended or adjusted under 35 U.S.C. 154(b) by 0 days.

(21) Appl. No.: 09/985,101

(22) Filed: Nov. 1, 2001

(65) Prior Publication Data

US 2003/0080596 A1 May 1, 2003

(51) Int. Cl.
*A47C 1/02* (2006.01)

(52) U.S. Cl. ..... 297/314; 297/313

(58) Field of Classification Search ..... 297/314, 297/312, 325, 188.08, 258.1, 337, 311, 452.39, 297/14, 273, 274; 248/143, 589, 618, 621, 248/603; 482/110, 123, 78; 108/57.12, 108/153.1; 52/167.7, 167.8, 403.1, 480; 472/103, 104, 105, 135

See application file for complete search history.

(56) References Cited

U.S. PATENT DOCUMENTS

| | | | | | |
|---|---|---|---|---|---|
| 135,973 | A | | 2/1873 | Doremus | |
| 150,825 | A | * | 5/1874 | Caldwell | 5/93.1 |
| 293,139 | A | * | 2/1884 | Bohlig | 280/1.192 |
| 401,179 | A | * | 4/1889 | Lea | 248/621 |
| 421,045 | A | * | 2/1890 | Cladwell | 297/302.4 |
| 929,272 | A | * | 7/1909 | Baron | 248/583 |
| 1,372,991 | A | * | 3/1921 | Beadle | 248/621 |
| 1,509,750 | A | * | 9/1924 | Helen | 482/26 |
| 1,979,892 | A | * | 11/1934 | Loeffler | 248/581 |
| 2,018,721 | A | | 10/1935 | Holtzman | |
| 2,607,397 | A | | 8/1952 | Schneider | |
| 2,799,323 | A | | 7/1957 | Berg | |
| 2,978,243 | A | * | 4/1961 | Harold | 472/14 |
| 3,351,027 | A | * | 11/1967 | Ellard Jr. et al. | 108/57.12 |
| 3,427,019 | A | * | 2/1969 | Brown | 482/77 |
| 4,438,919 | A | * | 3/1984 | Gamzo | 472/134 |
| 4,491,318 | A | * | 1/1985 | Francke | 482/147 |
| 4,524,762 | A | | 6/1985 | Schulman | |
| 4,641,848 | A | | 2/1987 | Ayers | |
| 4,650,247 | A | | 3/1987 | Berg et al. | |
| 4,893,809 | A | * | 1/1990 | Blankenzee | 482/77 |
| 5,024,485 | A | | 6/1991 | Berg et al. | |
| 5,288,127 | A | | 2/1994 | Berg et al. | |
| 5,397,163 | A | * | 3/1995 | Puerner | 297/273 |
| 5,558,314 | A | | 9/1996 | Weinstein | |
| 5,577,801 | A | | 11/1996 | Glockl | |
| 5,577,803 | A | * | 11/1996 | Guilbaud | 297/314 |
| 5,584,787 | A | * | 12/1996 | Guidry | 482/146 |
| 5,588,704 | A | | 12/1996 | Harza | |
| 5,704,882 | A | * | 1/1998 | Coates et al. | 482/69 |
| 5,735,573 | A | | 4/1998 | Vredevoogd | |

(Continued)

*Primary Examiner*—Peter M. Coumo
*Assistant Examiner*—Sarah B. McPartlin
(74) *Attorney, Agent, or Firm*—J. Bruce Hoofnagle

(57) ABSTRACT

A seating structure 30 includes spaced housings 34 and 36 between which a seating portion 92 of a platform 60 is located. The platform 60 is also formed with non-seating portions 94*a* and 94*b* at opposite sides of the seating portion 92, which are isolated and are within the housings 34 and 36, respectively. The non-seating portions 94*a* and 94*b* engage resilient elements 90*a* through 90*h* above and below the non-seating portions. When a user sits on the seating portion 92, the resilient elements 90*a* through 90*h* provide a buoyant and floating experience for the user. The seating portion 92 is movable relative to the housings 34 and 36 to allow for outward movement and for a rocking action.

29 Claims, 10 Drawing Sheets

U.S. PATENT DOCUMENTS 5,769,492 A * 6/1998 Jensen ..... 297/314
5,816,983 A * 10/1998 Dawes et al. ..... 482/78
5,913,568 A 6/1999 Brightbill
6,019,712 A * 2/2000 Duncan ..... 482/110
6,030,039 A * 2/2000 Essler ..... 297/273
6,079,782 A 6/2000 Berg et al.
6,086,151 A 7/2000 Vanharanta
6,139,095 A 10/2000 Robertshaw
6,370,716 B1 * 4/2002 Wilkinson ..... 5/715
6,390,551 B1 * 5/2002 Hendrickson ..... 297/250.1

* cited by examiner

RESILIENT SEATING STRUCTURE

BACKGROUND OF THE INVENTION

This invention relates to a resilient seating structure, and particularly relates to a seating structure which provides buoyant seating for a user sitting on the seating structure, and further particularly relates to a seating structure which is rockable by the user.

Many types of currently available seating structures provide a user with resilient seating accommodations. Such structures typically include some form of support, with resilient structure, directly beneath the area where the user sits. The resilient structure could include various types of springs having compressive properties, various elements having resilient properties, and the like, all of which are compressed when the user is seated on the seating structure and which return to a normal extension when the user withdraws from the seating structure. Some seating structures of the present include facility which allow the user to rock the structures.

An example of a seating structure with a resilient and a rockable seating area is disclosed and illustrated in U.S. Pat. No. 5,913,568, which issued to Stephen T. Brightbill and David W. Flesner on Jun. 22, 1999. The seating structure of this patent includes two, identical, moving seat assemblies, which are located side by side, and which, in their entirety, define a seating area of the structure. Each seating assembly includes a seat platform situated on resilient structure located only directly beneath the seating area of the seating structure. The resilient structure includes any of several types of "motion mechanisms" which could be pneumatic (e.g., air bladder), hydraulic, magnetic, or motorized mechanisms. The "motion mechanisms" could also include springs having a variety of configurations as illustrated in U.S. Pat. No. 5,913,568.

Another example of a seating structure having a resilient seating area is disclosed and illustrated in U.S. Pat. No. 6,139,095, which issued to Richard C. Robertshaw on Oct. 31, 2000. The seating structure of this patent also includes two, identical, moving seat assemblies, which are located side by side, and which, in their entirety, define a seating area. In one embodiment, each seating assembly includes a seat platform situated on a plurality of flexible rubber balls located only directly beneath the seating area of the seating structure.

Each of the seating structures described and illustrated in U.S. Pat. Nos. 5,913,568 and 6,139,095 include two platforms which form the seat area for receipt of the left and right buttocks, and portions of the respective left and right thighs, of the user of the seating structure. The resilient structure below the two platforms, in each patent, allows the raising and lowering of one platform relative to the other platform, and a tilting or rocking effect of each platform, to accommodate the leaning and shifting action of the user seated in the seat area. This accommodation results from the placement of the resilient structure only directly beneath the seat area, thereby exerting a force directly toward the buttocks and thighs of the user.

While the seating structures of U.S. Pat. Nos. 5,913,568 and 6,139,095 provide a useful function and purpose, there is a need for a seating structure which does not apply a force directly toward the seated anatomy of the user. Also, there is a need for a seating structure which provides a feeling of buoyancy for the user of the seating structure. Further, there is a need for a seating structure which is rockable, while providing a feeling of buoyancy.

SUMMARY OF THE INVENTION

Therefore, it is an object of this invention to provide a seating structure which does not apply a force directly toward the seated anatomy of the user.

Another object of this invention is to provide a seating structure which provides a feeling of buoyancy for the seated user thereof.

A further object of this invention is to provide a seating structure which is rockable, while providing a feeling of buoyancy.

With these and other objects in mind, this invention contemplates a seating structure, which includes a frame, a platform formed with a seating portion, and means for supporting the platform in a floating relation to the frame independently of engagement with the seating portion.

This invention also contemplates a seating structure wherein the platform is formed with a non-seating portion and the means for supporting the platform is captured between, and in engagement with, spaced portions of the frame and the non-seating portion of the platform.

This invention further contemplates a seating structure wherein the non-seating portion is adjacent the seating portion, has surfaces on opposite sides thereof, and the means for supporting the platform is in engagement with the surfaces on opposite sides of the non-seating portion thereof for supporting the seating portion of the platform in a floating relation to the frame.

Additionally, this invention contemplates a seating structure, which includes means, positioned adjacent the means for supporting the platform, for precluding any movement of the means for supporting in a direction of the means for precluding.

Also, this invention contemplates a seating structure which is rockable while supporting the seating portion of the platform in a floating relation to the frame.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 3 is a mirror image, and representative, of a rear view of the seating structure, all in accordance with certain principles of the invention;

FIG. 5 is a mirror image, and representative, of a left side view of the seating structure, all in accordance with certain principles of the invention;

FIG. 8 is a mirror image, and representative, of a partial rear view of the seating structure, all showing a platform of the seating structure of FIG. 1 in a tilted position to illustrate the side-to-side rockability of the platform, in accordance with certain principles of the invention;

FIG. 9 is a mirror image, and representative of, a sectional view of a portion of a right side of the seating structure, all to illustrate the front-to-rear rockability of the platform, in accordance with certain principles of the invention;

FIG. 11 is a mirror image, and representative, of a rear view, a right side view, and a left side view of the platform, all to illustrate the front-to-rear and the right side-to-left side rockability of the platform, in accordance with certain principles of the invention;

DETAILED DESCRIPTION OF THE PREFERRED EMBODIMENTS OF THE INVENTION

Figure 1:
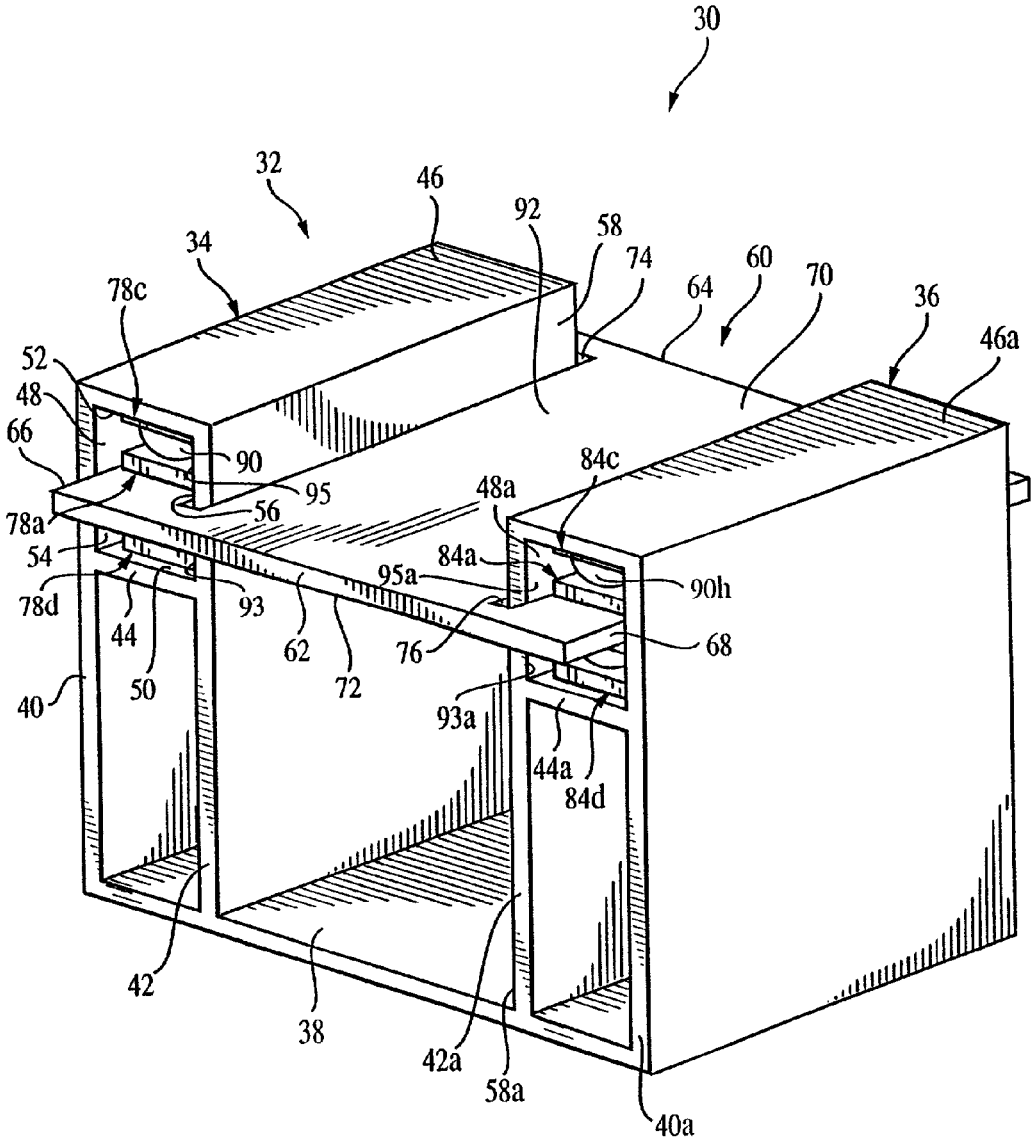
FIG. 1 is a perspective view showing a seating structure with resilient elements which are spherical and compressible, in accordance with certain principles of the invention.
Figure 2:
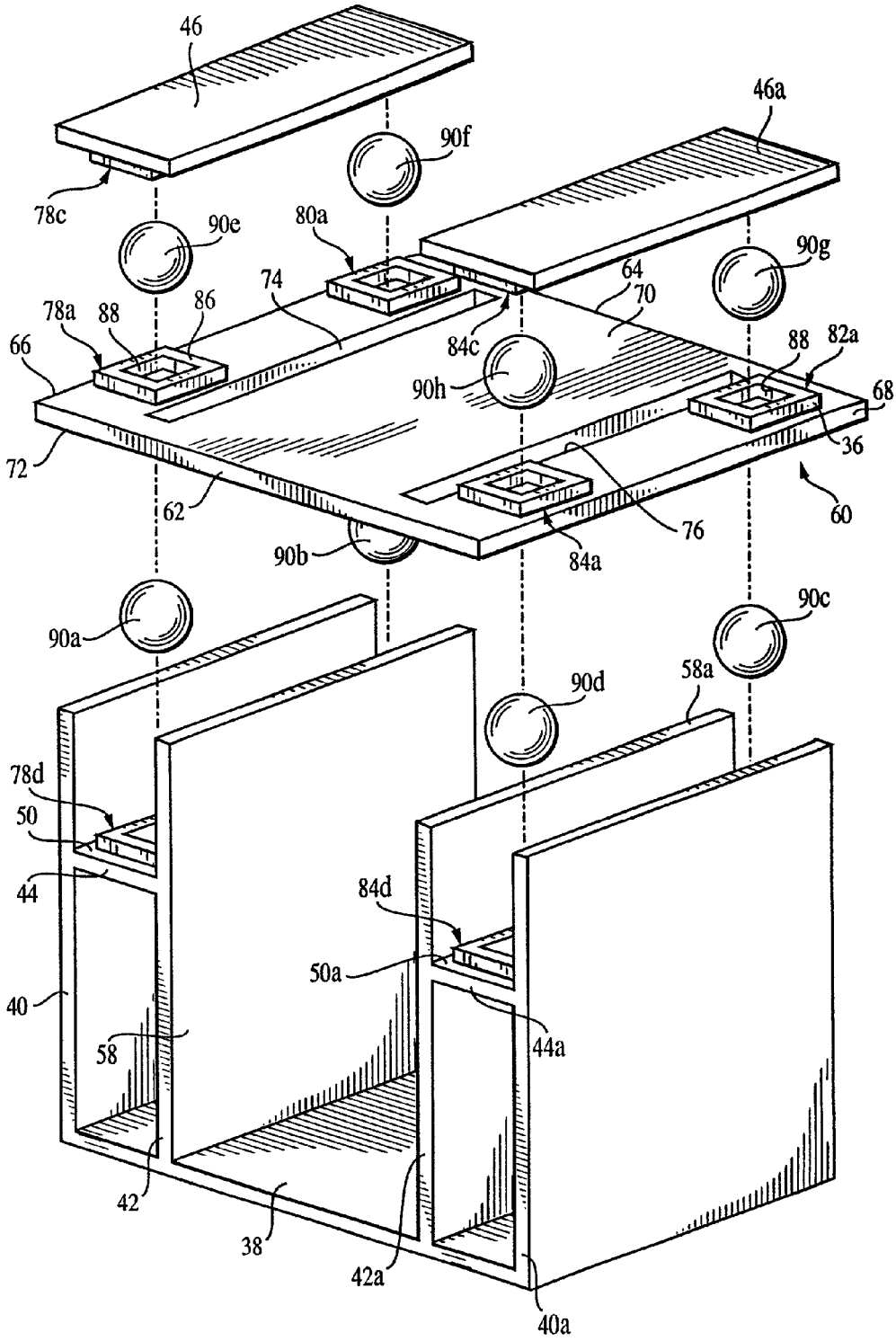
FIG. 2 is an exploded perspective view of the seating structure of FIG. 1, in accordance with certain principles of the invention.

Referring to FIGS. 1 and 2, a seating structure 30 is formed with a frame 32 which includes a first housing 34 and a second housing 36, spaced from the first housing. The spaced first housing 34 and the second housing 36 are attached to spaced portions of a common exposed surface of a base plate 38. The first housing 34 is formed with an outboard side panel 40 and an inboard side panel 42, each of which extend from, and are attached at a bottom edge thereof to, the exposed upper surface of the base plate 38. A shelf 44, extends between, and is attached to, spaced intermediate portions of the side panels 40 and 42. An enclosure plate 46 extends between, and is attached to, upper edges of the side panels 40 and 42, which are opposite the bottom edges which are attached to the base plate 38.

A compartment 48 is formed in the housing 34 between a lower or base surface 50 of the shelf 44 and a spaced upper surface 52 of the plate 46. Also, inboard surfaces S4 and 56 of the side panels 40 and 42, respectively, provide opposite side enclosures of the compartment 48. The side panel 42 is also formed with an outboard surface 58. Further, the compartment 48 is open at front and rear ends thereof in the preferred embodiment, but could be closed without departing from the spirit and scope of the invention.

It is noted that the housing 34 could be formed without the portion of side panel 40, which includes the surface 54, without departing from the spirit and scope of the invention.

The housing 36 is constructed in the same manner as the housing 34, as described above. Therefore, the various structural features and relationships of the elements of the housing 36 will not be described herein, but will be identified by the numeral of the corresponding element of the housing 34, followed by the letter "a." For example, the inboard side panel of the housing 36 will be identified as "panel 42*a*."

The seating structure 30 further includes a platform 60 which is formed with a front edge 62, a rear edge 64, a right-side edge 66 and a left-side edge 68. The platform 60 is also formed with an upper surface 70 and an undersurface 72. In the preferred embodiment of the invention, the platform 60 is formed in the shape of a rectangle, with a right side-to-left side dimension being slightly greater than a front-to-rear dimension. The platform 60 could be formed dimensionally different and in many other shapes, other than rectangular, without departing from the spirit and scope of the invention. For example, the platform 60 could be, but not limited to, such shapes as round, oblong, square, etc., or one or more of the edges 62, 64, 66 and 68 could be formed with an arcuate shape.

A pair of spaced, parallel, enclosed elongated slots 74 and 76, with closed ends, are formed through the platform 60 and extend from a location near the front edge 62 of the platform to a location near the rear edge 64 thereof. In addition, the slot 74 is located inboard of the right-side edge 66 of the platform 60 by a first prescribed distance. Also, the slot 76 is located inboard of the left side edge 68 of the platform 60 by a second prescribed distance, which, in the preferred embodiment, is the same as the first prescribed distance, but could be different therefrom without departing from the spirit and scope of the invention.

Figure 4:
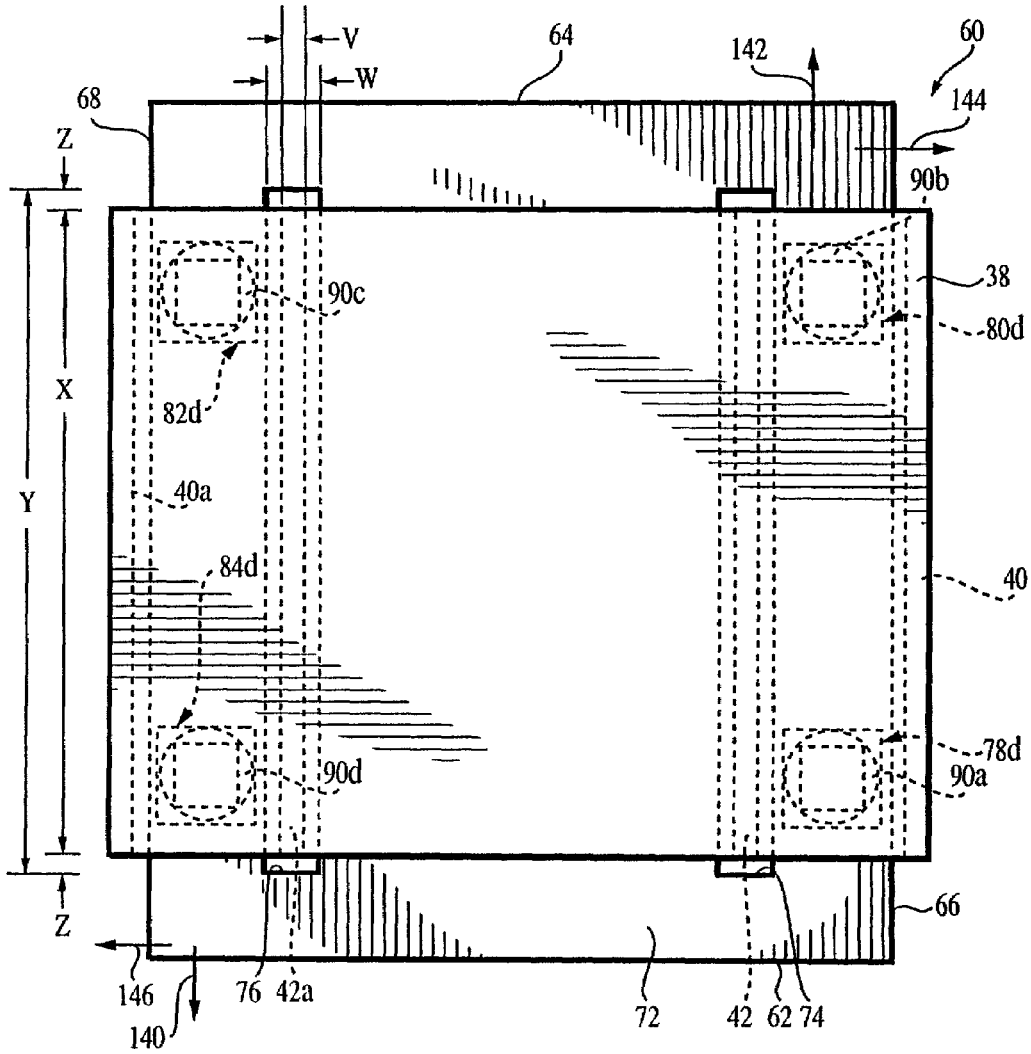
FIG. 4 is a bottom view of the seating structure of FIG. 1, in accordance with certain principles of the invention.

Referring to FIGS. 1, 2 and 4, during assembly of the components of the seating structure, which will be described below, the slots 74 and 76 of the platform 60 are positionable over the inboard side panels 42 and 42*a*, respectively, prior to assembly of the enclosure plates 46 and 46*a* with the upper edges of the outboard side panels 40 and 40*a* and the inboard side panels 42 and 42*a*.

As shown in FIG. 4, which is a view from the underside of the base plate 38, each of the inboard side panels 42 and 42*a* have a prescribed side panel width "v," while the slots 74 and 76 have a prescribed slot width "w" which is greater than the width "v." Further, the inboard side panels 42 and 42*a* have a prescribed front-to-rear length "x," while each of the slots 74 and 76 have a prescribed slot length "y," such that when the slots are centrally positioned lengthwise over the inboard side panels, the opposite ends of the slots extend beyond the adjacent edges of the respective inboard side panels by a distance "z." Thus, a space or clearance exists between portions of the walls of the slots 74 and 76 and the adjacent portions of the inboard side panels 42 and 42*a*, respectively, which provides for movement of the panel 60 relative to the inboard side panels.

As shown in FIG. 2, each of a plurality of retaining wells or cribs 78*a*, 80*a*, 82*a* and 84*a* includes four rails 86 which, in the preferred embodiment, are assembled and secured in a square configuration to form an enclosure 88. The four cribs 78*a*, 80*a*, 82*a* and 84*a* are attached, at four spaced locations, to the upper surface 70 of the platform 60, near the corners thereof. The two spaced cribs 78*a* and 80*a* are located between the right-side edge 66 and the slot 74 of the platform 60. The remaining two spaced cribs 82*a* and 84*a* are located between the left-side edge 68 and the slot 76 of the platform 60.

Figure 3:
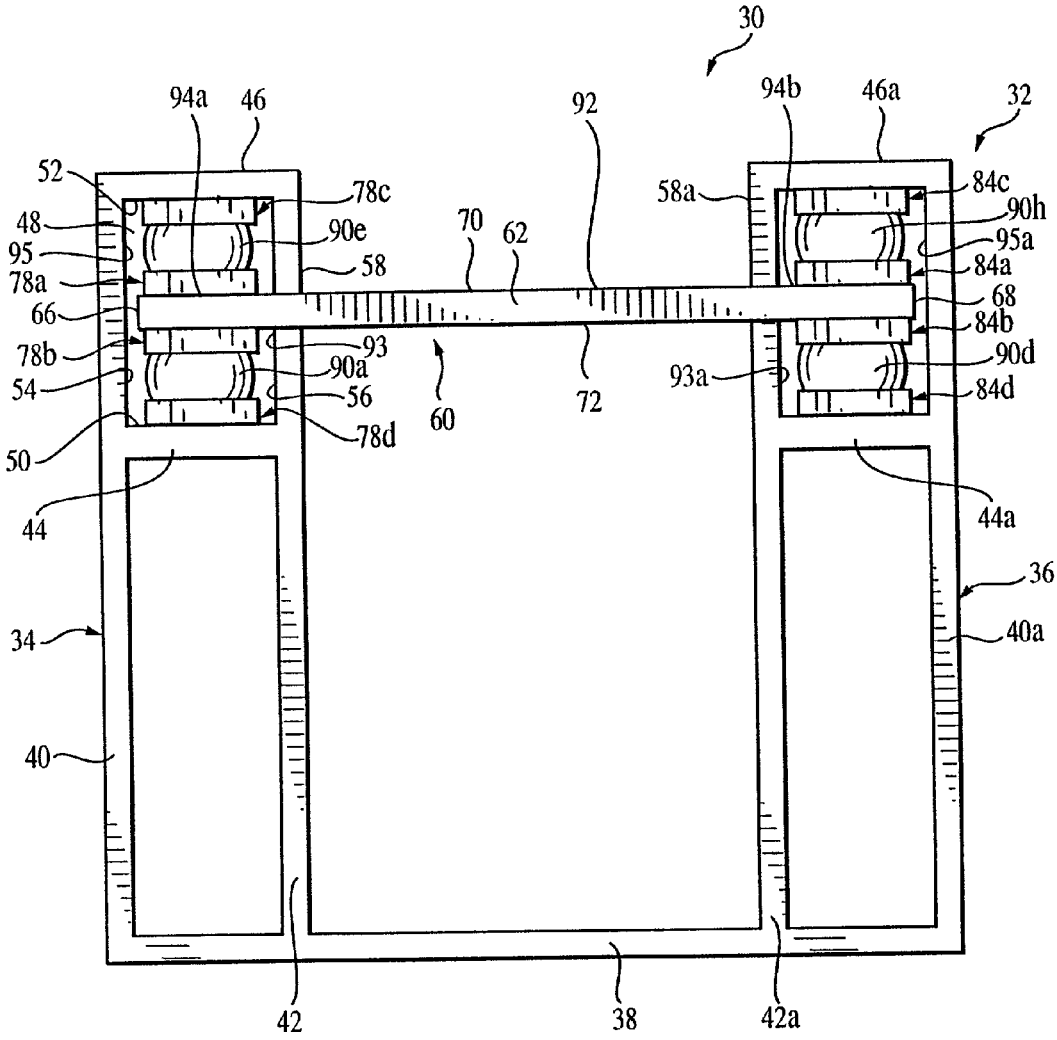
FIG. 3 is a front view of the seating structure of FIG. 1 in a static state position, and, because of the symmetry of the seating structure.
Figure 5:
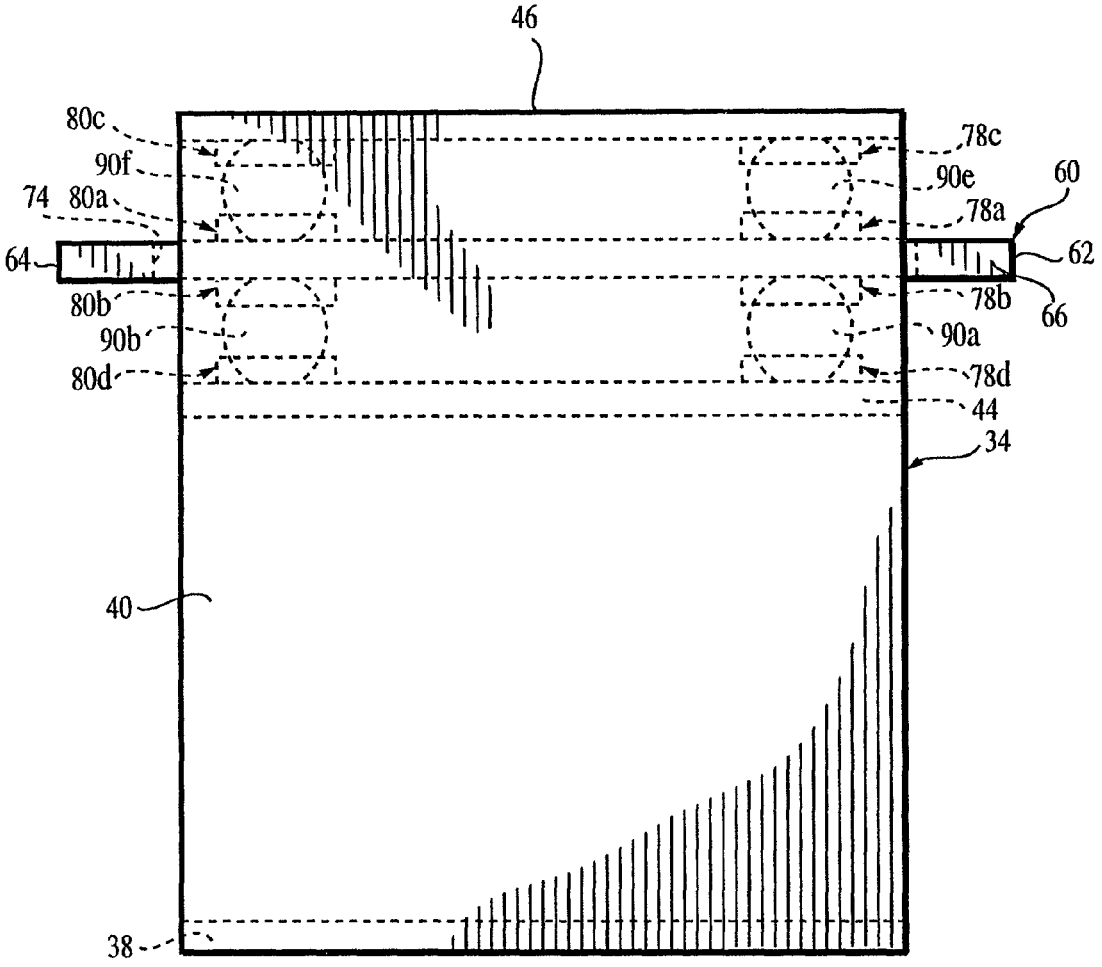
FIG. 5 is a right side view of the seating structure of FIG. 1, and, because of the symmetry of the seating structure.
Figure 8:
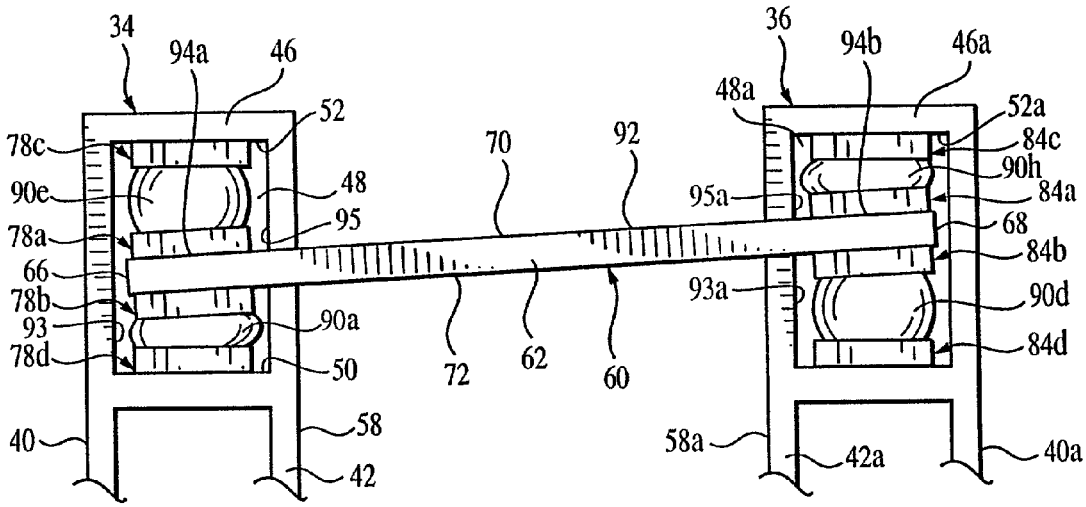
FIG. 8 is a partial front view of the seating structure of FIG. 1, and, because of the symmetry of the seating structure.

Referring to FIGS. 3, 5 and 8, three other cribs 78*b*, 78*c* and 78*d* are stacked in spaced alignment with the crib 78*a*. The crib 78*b* is attached to the surface 72 of the platform 60, the crib 78*c* is attached to the surface 52 of the enclosure plate 46, and the crib 78*d* is attached to the surface 50 of the shelf 44. In like fashion, three cribs 80*b*, 80*c*, and 80*d* are attached to adjacent structure of the seat structure 30 in stacked, spaced alignment with the crib 80*a*. Also, in like fashion, three cribs 82*b*, 82*c* and 82*d* are attached to adjacent respective portions of the seat structure 30 in stacked, spaced alignment with the crib 82*a*. Further, in like fashion, three cribs 84*b*, 84*c*, and 84*d* are attached to adjacent structure of the seat structure 30 in stacked, spaced alignment with the crib 84*a*.

Each of the cribs 78*a*, 80*a*, 82*a* and 84*a*, and the corresponding alpha-numerically identified cribs (e.g., 78*b*) could be structured to form the enclosure 88 having a configuration other than a square configuration without departing from the spirit and scope of the invention. For example, the enclosure 88 of each crib could be round, diamond shaped, oblong, oval, triangular, or any shape which will perform the function of the crib, as described hereinbelow.

It is noted that the floors of the plurality of cribs 78*a* through 78*d*, 80*a* through 80*d*, 82*a* through 82*d*, and 84*a* through 84*d*, define prescribed portions of the respective elements to which the cribs are attached such as, for example, the shelves 44 and 44*a*, the platform 60, and the enclosure plates 46 and 46*a*.

Referring to FIG. 2, the seating structure 30 further includes eight resilient elements 90*a* through 90*h*, each of which, in the preferred embodiment, are in the form of a shell which is spherical in shape when filled with a pressurized medium, and is compressible. The resilient elements 90*a* through 90*h* could be hollow internally, with a pressurized medium such as, for example, air, or they could be formed throughout from a compressible material such as, for example, rubber or any compressible material having resilient characteristics similar to rubber. The resilient elements 90*a* through 90*h* could also be formed with a solid core surrounded with pressurized-medium-filled hollow chamber between the solid core and an outer skin of the resilient elements. Also, the resilient elements 90*a* through 90*h* could be formed in any suitable configuration other than spherical, provided that the material thereof is resilient and compressible. Examples of such suitable configurations are cubic, a mass with a rectangular and/or a triangular surface, frustoconical, oval, oblong and the like. All of the above-described various embodiments of the resilient elements 90*a* through 90*h* could be used as components of the seat structure 30 without departing from the spirit and scope of the invention.

When assembling the components of the seat structure 30, a lower portion of each of the resilient elements 90*a*, 90*b*, 90*c* and 90*d* is positioned in the cribs 78*d*, 80*d*, 82*d* and 84*d*, respectively, and are adjacent the floor of the respective crib. Rather than being adjacent the floor of the respective crib, each of the resilient elements 90*a* through 90*h* could be in engagement with the floor of the respective crib without departing from the spirit and scope of the invention. The platform 60 is then manipulated to align the slots 74 and 76 with the inboard side panels 42 and 42*a*, respectively, and the platform is moved to position the slots over and about the respective inboard side panels, as described above.

It is noted that, as shown in FIGS. 1, 3 and 4, the width of the platform 60, between side edges 66 and 68 thereof, is less than the distance between the spaced inboard surfaces 54 and 54*a* of the outboard side panels 40 and 40*a*, respectively. Therefore, the platform 60 is movable to a position below a plane defined by the upper edges of the side panels 40, 40*a*, 42 and 42*a*, to locate and position the upper portions of the resilient elements 90*a*, 90*b*, 90*c* and 90*d* within the cribs 78*b*, 80*b*, 82*b* and 84*b*, respectively, which are attached to the inboard surface 72 of the platform near the four corners thereof.

In this position, the upper portions of the resilient elements 90*a*, 90*b*, 90*c* and 90*d* are adjacent, and could be in engagement with, the floors of the respective cribs 78*b*, 80*b*, 82*b* and 84*b*. Thereafter, a lower portion of each of the remaining resilient elements 90*e*, 90*f*, 90*g* and 90*h* is positioned in, and adjacent, and could be in engagement with the floor of, the cribs 78*b*, 80*b*, 82*b* and 84*b*, respectively. In this crib-nested position, an upper portion of each of the resilient elements 90*e*, 90*f*, 90*g* and 90*h* extends to a plane which is slightly above the top edges of the outboard side panels 40 and 40*a*, and the inboard side panels 42 and 42*a*.

It is further noted that, as shown in FIGS. 1, 4 and 5, the length of the platform 60, between the front edge 62 to the rear edge 64 thereof, is greater than the distance between the front and rear of the housings 34 and 36. Consequently, portions of the platform 60, which are adjacent the front edge 62 and the rear edge 64 extend beyond the front and rear of the housings 34 and 36.

Referring again to FIG. 2, the enclosure plate 46 is assembled on the upper edges of the outboard side panel 40 and the inboard side panel 42, whereby the upper portions of the resilient elements 90*e* and 90*f* nest in, and may engage the floors of, the cribs 78*c* and 80*c*, respectively. In similar fashion, the enclosure plate 46*a* is assembled on the upper edges of the outboard side panel 40*a* and the inboard side panel 42*a*, whereby the upper portions of the resilient elements 90*g* and 90*h* nest in, and may engage the floors of, the cribs 82*c* and 84*c*, respectively.

When the enclosure plates 46 and 46*a* are assembled with respective side panels, the resilient elements 90*a* through 90*h* are slightly compressed due to the vertical spacing within the respective compartments 48 and 48*a*. This slight compression results in the application of low-level forces to both sides of the platform 60 to thereby maintain the platform at a rest position, or static state position, as illustrated in FIG. 3. The rest, or static state, position represents the position which the platform 60 normally assumes when the seating structure 30 is not being used.

In the static state position as viewed in FIG. 3, the platform 60 is now held in a buoyant and floating position between a first set of four points on the inboard surface 72 near the four corners of the platform, and a second set of four points on the upper surface 70 near the four corners of the platform, where the first and second sets of four points are in respective alignment, all defining a four-points arrangement.

Under the four-points arrangement, as described above, on a lower level below the platform 60, the resilient elements 90*a* through 90*d* engage the floors of the respective cribs 78*b*, 80*b*, 82*b* and 84*b*. Further, under the four-points arrangement, on an upper level above the platform 60, the resilient elements 90*e* through 90*h* engage the floors of the respective cribs 78*a*, 80*a*, 82*a* and 84*a*. In this buoyant position, the platform 60 is not touching any hard surface of the remainder of the seating structure 30 and is essentially floating due to the resiliency of the resilient elements 90*a* through 90*h*. In effect then, the platform 60 is captured between two layers of the resilient elements 90*a* through 90*h*. It is noted that the seating structure 30 could function to support a user, particularly in the centrally balanced position, with only the first set of resilient elements 90*a* through 90*d*, all of which would be in engagement with the undersurface 72 of the platform 60 in the non-seating portions 94*a* and 94*b*, without departing from the spirit and scope of the invention.

It is noted that the upper and lower portions of the resilient elements 90*a* through 90*h*, which normally engage the floors of the respective cribs as described above, may be nested sufficiently within the respective cribs to perform the functions thereof without engagement with the floors of the respective cribs, all without departing from the spirit and scope of the invention.

Referring to FIGS. 1, 3 and 8, a section of the platform 60, as an assembled component of the seating structure 30, forms a seating portion 92 of the platform and the structure, which, generally, is located between the slots 74 and 76 thereof. The width of the seating portion 92 is defined by the space between the interfacing outer surfaces 58 and 58*a* of the inboard side panels 42 and 42*a*, respectively. Therefore, the interfacing outer surfaces 58 and 58*a* of the panels 42 and 42*a*, respectively, are located in respective planes in which are located a first side edge and a second edge, respectively, of the seating portion 92. The seating portion 92 defines the area of the seating structure 30 on which a user of the structure will sit, and includes a seating or upper surface on a first major surface of the seating portion, and an undersurface on a second major surface of the seating portion opposite the first major surface thereof.

The resilient elements 90*a* through 90*h*, which contain a pressurized medium, constitute an enclosed compliant expandable shell having a prescribed amount of the pressurized medium within the shell, which expands the shell to a prescribed configuration. The compliancy of the shell then allows the shell to assume a configuration other than the prescribed configuration when a person sits on the seating portion 92 of the platform 60.

Also, as an assembled component of the seating structure 30, sections of the platform 60, outboard from the seating portion 92, form non-seating portions 94*a* and 94*b*. The non-seating portion 94*a* is located between the edge 66 of the platform 60 and the slot 74, and the non-seating portion 94*b* is located between the edge 68 of the platform and the slot 76 thereof. The non-seating portions 94*a* and 94*b* define the portions of the platform 60 which are not used by the user. It is noted that the non-seating portions 94*a* and 94*b* are located substantially within the compartments 48 and 48*a*, respectively, of the housings 34 and 36, respectively, which provide enclosed protective chambers for the resilient elements 90*a* through 90*h* in their mounted and functioning locations.

The platform 60 is formed with the upper surface 70 and the undersurface 72. Since the seating portion 92, and the non-seating portions 94*a* and 94*b*, are formed by the platform 60, any reference herein to an upper surface and/or an undersurface of the seating portion and the non-seating portions will be to those portions of the upper surface 70 and the undersurface 72 of the platform which form the upper surfaces and the undersurfaces of the seating portion and the non-seating portions.

Further, the terms "upper surface" and "undersurface" as used herein to identify surfaces of the platform 60, are used for descriptive purposes only, in the context of the orientation of the seating structure 30 as illustrated in the drawings and figures hereof. In practical use, the seating structure 30 could be placed in other orientations, i.e., other than the orientation illustrated in the drawings and figures hereof. With respect to such other orientations, it is to be understood that the terms "upper surface" and "undersurface" will continue to identify the surfaces 70 and 72 of the platform 60 notwithstanding that such surfaces are not an upper surface or an undersurface in such other orientations.

The non-seating portion 94*a* of the platform 60 separates the compartment 48 into two cells 93 and 95. Cell 93 extends between the shelf 44 and the non-seating portion 94*a*, and represents a first cell adjacent the undersurface 72 of the platform 60. Cell 95 extends between the non-seating portion 94*a* and the enclosure plate 46, and represents a second cell adjacent the upper surface 70 of the platform 60. Similar cells 93*a* and 95*a* are formed below and above, respectively, the non-seating portion 94*b*. Therefore, resilient elements 90*a* and 90*b* are located in cell 93, resilient elements 90*e* and 90*f* are located in cell 95, resilient elements 90*c* and 90*d* are located in cell 93*a*, and resilient elements 90*g* and 90*h* are located in cell 95*a*.

In one aspect of the invention, a user sits on the seating portion 92 of the platform 60 in a centrally balanced position with the user's legs over the front edge 62 of the platform. In this centrally balanced position, each of the lower resilient members 90*a* through 90*d* are compressed and distorted from the static state position, all generally at about the same amount, in response to the weight of the user. At the same time, the upper resilient elements 90*e* through 90*h* will relax slightly from their static state position, but will remain firmly in the platform-supporting mode to preclude a sudden upward thrust of the platform 60. A sudden upward thrust could occur when the user shifts positions on the seating portion 92, which results in the tilting thereof. In the tilted position, selected ones of the upper resilient elements 90*e* through 90*h* will be compressed such as, for example, resilient element 90*h*, as illustrated in FIG. 8.

During the period when the user is sitting in the centrally balanced position, the user experiences a sense of buoyancy and floating support by virtue of the resilient members 90*a* through 90*d*, which are located below the non-seating portions 94*a* and 94*b* of the platform. The buoyancy and floating sensation experienced by the user is further enhanced by the placement of the resilient members 90*a* through 90*d* under the non-seating portions 94*a* and 94*b* only, and not under the seating portion 92, whereby there are no impediments or obstructions beneath the seating portion 92 at any time, including all periods when the seating portion is occupied by the user.

It is noted that the edge 68 of the platform 60, which is an outboard edge of the non-seating portion 94*b*, could be attached to a vertical slide (not shown), or attached to a hinge, and a single resilient element such as, for example, the resilient element 90*a*, could be placed between, and nested in the respective cribs on, the shelf 44 and the undersurface 72 of the platform 60 at the non-seating portions 94*a*, or in engagement with the floors of the respective cribs, to provide the buoyant and floating effect for the seating portion 92, all without departing from the spirit and scope of the invention.

It is also noted that the seating structure 30 could function to support a user with only the first set of resilient elements 90*a* through 90*d*, all of which would be between, and nested in the respective cribs on, the shelves 44 and 44*a*, and the undersurface 72 of the platform 60 at the non-seating portions 94*a* and 94*b*, or in engagement with the floors of the respective cribs, all without departing from the spirit and scope of the invention.

In the preferred embodiment, the platform 60 is composed of a generally rigid material such as, for example, wood. However, the platform 60 could be composed of any other suitable material such as, for example, metal or plastic materials, without departing from the spirit and scope of the invention.

Also, with no impediments below the seating portion 92, the seating portion tends to droop slightly, in the context of a catenary effect, when the user is sitting thereon. The amount of the droop depends upon the thickness and rigidity characteristics of the material of which the seating portion 92 is composed. This catenary-effect property of the seating structure 30 further enhances the buoyancy and floating effect experienced by the user.

Referring to FIG. 8, which is a front view, in another aspect of the invention, when the user sits on the seating portion 92 with the user's legs over the front edge 62 of the platform 60, and the user leans to the user's right, the seating portion will tilt as illustrated. If the user leans to the user's left, the seating portion 92 will tilt in a direction opposite to the tilt direction illustrated in FIG. 8.

Figure 11:
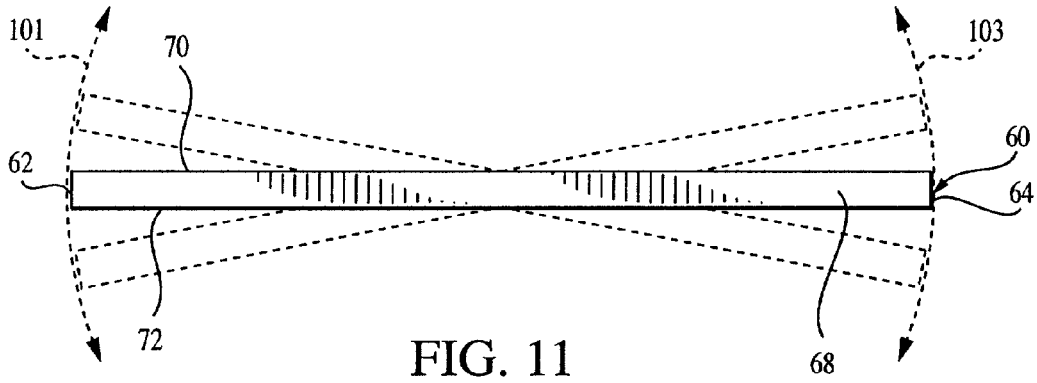
FIG. 11 is a front view of the platform of FIG. 8, and, because of the symmetry of the seating structure.

Referring to FIG. 4, there is a dimensional difference between the length "x" of the panels 42 and 42*a*, and the length "y" of the slots 74 and 76, respectively, with that difference being represented by a clearance distance (2z), which is equal to twice the value of the distance "z" at opposite ends of the panels and the slots. The clearance distance (2z), and its structural relationship with the slots 74 and 76 of the platform 60, and the panels 42 and 42*a*, provide a means for allowing movement of the platform, relative to the frame 32, in an arcing direction, as illustrated in FIG. 11, about the front edge 62, as represented by dashed/arrow line 101. and the rear edge 64, as represented by dashed/arrow line 103, of the platform, and thereby the seating portion 92.

Also, the clearance distance (2z), and its structural relationship with the slots 74 and 76 of the platform 60, and the panels 42 and 42*a*, provide a means for allowing movement of the platform 60, and thereby the seat portion 92, relative to the frame 32, in an outward direction, from the front edge 62 and the rear edge 68, as indicated by directional arrows 140 and 142, respectively.

Figure 9:
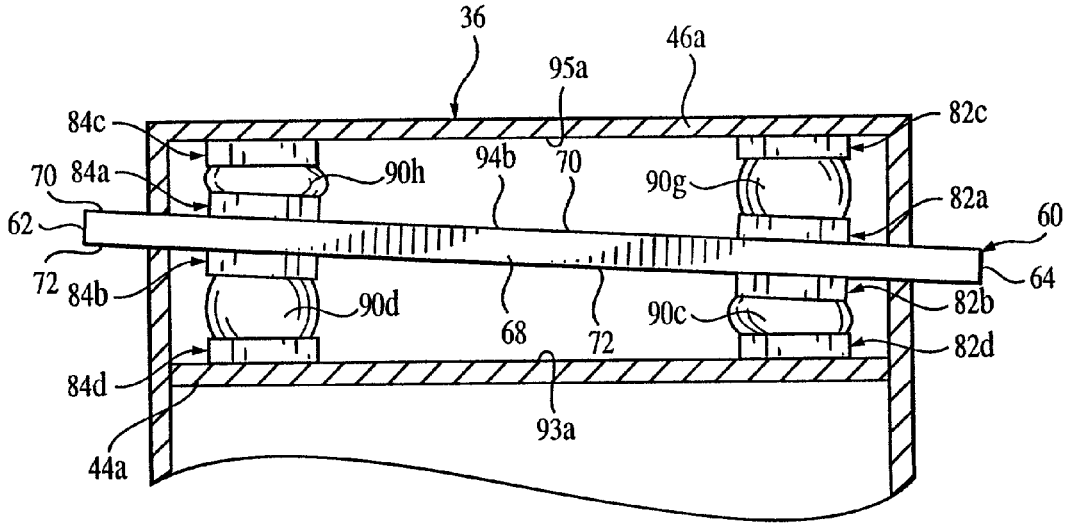
FIG. 9 is a sectional view of a portion of a left side of the seating structure of FIG. 1, showing the platform of FIG. 8 in a tilted position, and, because of the symmetry of the seating structure.

Referring to FIG. 9, which is a left side sectional view, when the user sits on the seating portion 92 with the user's legs over the front edge 62 of the platform 60, and the user leans to the rear of the platform 60, the platform, and thus the seating portion, will tilt as illustrated. If the user leans forward, the seating portion 92 will tilt in a direction opposite from the direction illustrated in FIG. 9.

Referring to FIG. 4, there is a dimensional difference between the width "v" of the panels 42 and 42*a*, and the width "w" of the slots 74 and 76, respectively, with that difference being represented by a clearance distance (w−v) which is equal to value of the distance "w" minus the value of the distance "v" laterally of the panels and the slots. The clearance distance (w−v), and its structural relationship with the slots 74 and 76 of the platform 60, and the panels 42 and 42*a*, provide a means for allowing movement of the platform, relative to the frame 32, in an arcing direction, in a manner similar to that illustrated in FIG. 11, about the right-side edge 66, as represented by the dashed/arrow line 101, and the left-side edge 68, as represented by the dashed/arrow line 103, of the platform, and thereby the seating portion 92.

Also, the clearance distance (w−v), and its structural relationship with the slots 74 and 76 of the platform 60, and the panels 42 and 42*a*, provide a means for allowing movement of the platform, and thereby the seating portion 92, relative to the frame 32, in an outward direction, from the right-side edge 66 and the left-side edge 68, as indicated by directional arrows 144 and 146, respectively, in FIG. 4.

Further, the seating portion 92 can be tilted and/or moved in compound tilting directions under the control of the user. For example, the user could lean in a direction which causes the seating portion 92 to tilt forward and to tilt to the right at the same time. The tilting feature of the seating structure 30 provides a rocking effect similar to that available with conventional rocking chairs, having bowed rocking rails which are located on the floor beneath the chair.

Consequently, the combination of the clearance distances (2z) and (w−v), and their structural relationships with the slots 74 and 76 of the platform 60, and the panels 42 and 42*a*, provide a means for allowing movement of the platform 60 in compound arcing directions, relative to the frame 32, which include at least two vector components of the arcing directions of movement on any adjacent two of the front edge 62, the rear edge 64, the right-side edge 66 and the left-side edge 68 of the platform, and thereby the seating portion 92. For example, referring to FIG. 9, the rear edge 64 has moved downward, in an arcing direction. If the left-side edge 68, which is adjacent the rear edge 64, is also moved downward, or upward, in an arcing direction, the platform 60 is moving in a compound arcing direction.

Also, the combination of the clearance distances (2z) and (w−v), and their structural relationships with the slots 74 and 76 of the platform 60, and the panels 42 and 42*a*, provide a means for allowing movement of the platform 60 in compound outward directions, which include vector components of the outward directions of movement, as illustrated by directional arrows 144, 146, 140 and 142 (FIG. 4), in any two adjacent edges of the front edge 62, the rear edge 64, the right-side edge 66 and the left-side edge 68, respectively, of the platform, and thereby the seating portion 92. For example, the front edge 62 and the right-side edge 66 are adjacent edges, while the front edge and the rear edge 64 are not adjacent edges. Movement of the platform 60 in the outward direction of the front edge 62, together with movement of the platform in the outward direction of the right-side edge 66, is an example of movement of the platform in a compound outward direction.

Further, the combination of the clearance distances (2z) and (w−v), and their structural relationship with the slots 74 and 76 of the platform 60, and the panels 42 and 42*a*, provide a means for allowing movement of the platform in compound arcing and outward directions, which include vector components of the arcing direction and the outward direction of movement, in any of the front edge 62, the rear edge 64, the right-side edge 66 and the left-side edge 68 of the platform, and thereby the seating portion 92. For example, movement of the platform 60 in an arcing direction of the front edge 62, and in an outward direction of the front edge, is movement of the platform in a compound arcing and outward direction.

The seating portion 92 is capable of being tilted in a variety of directions as described above because the slots 74 and 76 are longer and wider than the length and width of the inboard side panels 42 and 42*a*, respectively, about which the slots are located, also as described above. A representation is illustrated in FIG. 11 of the rocking effect of the platform 60, and thereby the seating portion 92.

As illustrated in FIGS. 8 and 9, when the seating portion 92 is tilted left or right, or forward or rearward, or any compound combinations of such tilting, one or more of the resilient members 90*a* through 90*h* will respond to maintain the buoyancy and floating sensation, while allowing the tilting action. For example, with the seating portion 92 being tilted as shown in FIG. 8, the diagonally spaced resilient elements 90*a* and 90*h* will be compressed and distorted, to a significant extent, from the static state position described above, and the diagonally spaced resilient elements 90*d* and 90*e* will relax slightly from the static state, also described above. At the same time, the remaining resilient elements 90*b*, 90*c*, 90*f* and 90*g*, which are not visible in FIG. 8, will respond in similar fashion. For example, referring to FIG. 2, resilient elements 90*b* and 90*g* will be compressed and distorted due to the forces imposed thereon by the tilt direction of the platform 60, while at the same time forces previously imposed on resilient elements 90*c* and 90*f* will relax slightly.

Even though the individual resilient elements 90*a* through 90*h* are either compressed or relaxed during the tilting of the seating portion 92, they are maintained in their respective four-point locations by the enclosures 88 of the cribs 78*a* through 78*d*, 80*a* through 80*d*, 82*a* through 82*d*, and 84*a* through 84*d*. In this manner, the resilient elements 90*a* through 90*h* continue to provide the buoyancy and floating effect, as described above, regardless of whether they are compressed or relaxed.

As described above, the frame 32 includes the first housing 34 and the second housing 36, which form compartments 48 and 48*a*, respectively, for protective and secluded cover for the non-seating portions 94*a* and 94*b* of the platform 60, the resilient elements 90*a* through 90*h*, and the cribs 78*a* through 78*d*, 80*a* through 80*d*, 82*a* through 82*d*, and 84*a* through 84*d*. The frame 32 could be constructed differently without departing from the spirit and scope of the invention. For example, the frame 32 could be constructed by the use of metal columns or rods which would replace the outboard side panels 40 and 40*a* and the inboard side panels 42 and 42*a*.

Figure 15:
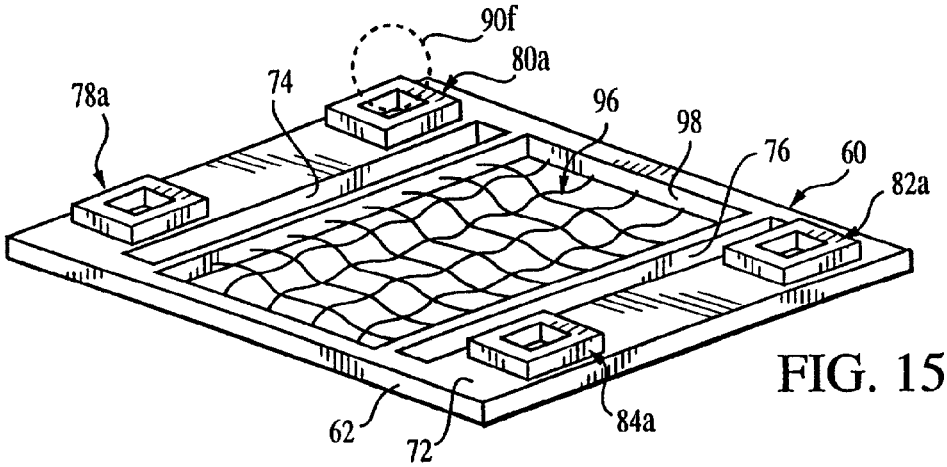
FIG. 15 is a perspective view showing web netting forming a seating portion of the platform of FIG. 8, and further showing a plurality of cribs mounted on the platform for restraining the resilient element of FIG. 1, in accordance with certain principles of the invention.

In the preferred embodiment, the seating portion 92 is formed integrally with the non-seating portions 94*a* and 94*b* as a single piece in the form of the platform 60. The seating portion 92 could be formed as a separate piece from, but attached to, the non-seating portions 94*a* and 94*b* without departing from the spirit and scope of the invention. In addition, the seating portion 92 could be formed, or covered, with softer cushioning material without departing from the spirit and scope of the invention. For example, the seat portion 92 could be made from a fabric of sufficient strength to support the user, or from a netting material 96, such as that illustrated in FIG. 15 where the netting material is attached to side walls 98 of an opening formed in the platform 60.

Figure 16:
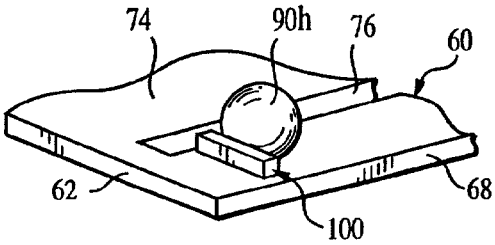
FIG. 16 is a perspective view of a portion of the platform of FIG. 8 showing a fence on the platform for restraining movement of the resilient element of FIG. 1 in a prescribed direction, in accordance with the principles of the invention.

While the cribs 78*a* through 78*d*, 80*a* through 80*d*, 82*a* through 82*d*, and 84*a* through 84*d* are formed to provide the enclosures 88, a fence 100, as shown in FIG. 16, could be used in place of each of the cribs to preclude movement of the resilient elements 90*a* through 90*h* in a given direction. Or a pair of the fences 100 could be used on opposite sides of the resilient elements to preclude, for example, forward and rearward, or side-to-side, movement. The single fence 100, or the pair of fences, could be used in place of the cribs without departing from the spirit and scope of the invention.

Figure 12:
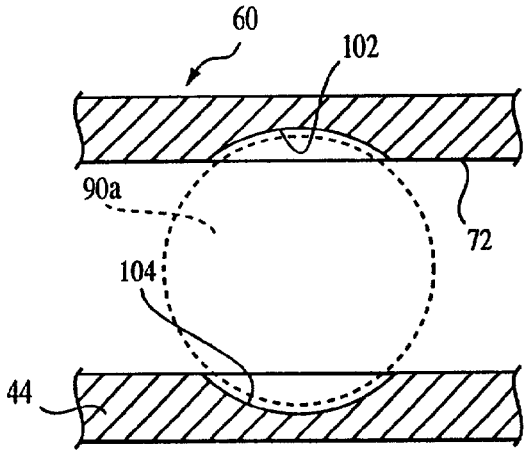
FIG. 12 is a partial view of a portion of the seating structure of FIG. 1 showing the resilient element of FIG. 1 located between the platform of FIG. 8 and the fixed portion of the frame of FIG. 10, in accordance with certain principles of the invention.
Figure 14:
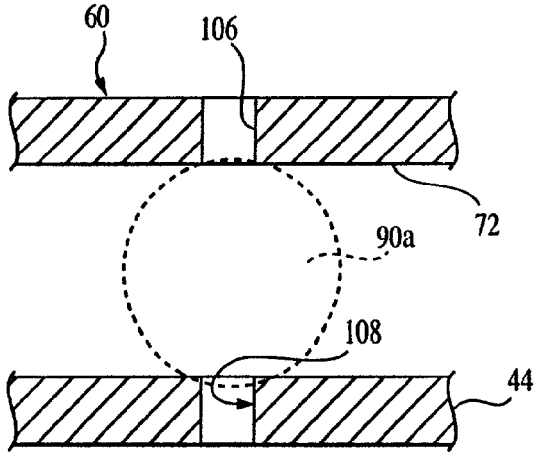
FIG. 14 is a partial view of a portion of the seating structure of FIG. 1 showing the resilient element of FIG. 1 located between the platform of FIG. 8 and the frame of FIG. 10, in accordance with certain principles of the invention.

Further, opposing recesses 102 and 104, as shown in FIG. 12, and openings 106 and 108, as shown in FIG. 14, can be formed in the shelves 44 and 44*a*, the four-point locations on the surface 70 and the surface 72 of the platform 60, and the surfaces 52 and 52*a* of the enclosure plates 46 and 46*a*, respectively, and can be used in place of the cribs for nesting the resilient elements 90*a* through 90*h*. The recesses 102 and 104, and the holes 106 and 108, can be used in place of the cribs without departing from the spirit and scope of the invention.

Figure 10:
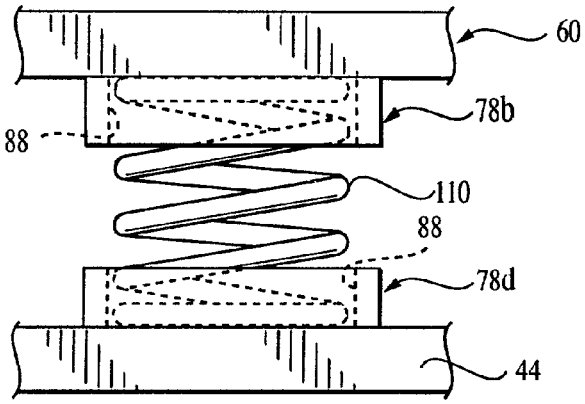
FIG. 10 is a partial view of a portion of the seating structure of FIG. 1 showing a resilient element in the form of a coil spring, which is located between the platform of FIG. 8 and a fixed portion of a frame, in accordance with certain principles of the invention.
Figure 13:
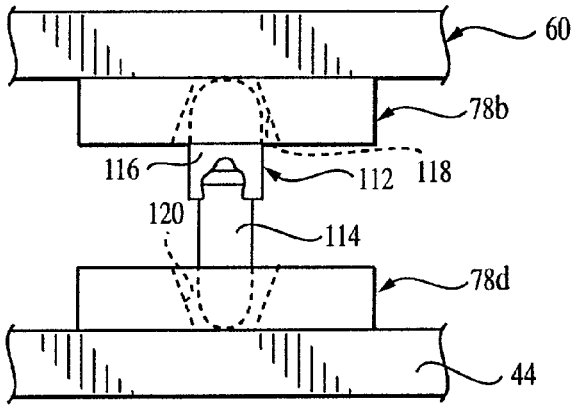
FIG. 13 is a partial view of a portion of the seating structure of FIG. 1 showing a resilient element in the form of a spring damper, which is located between the platform of FIG. 8 and the frame of FIG. 10, in accordance with certain principles of the invention.

A coil spring 110, as shown in FIG. 10, or a spring damper 112, as shown in FIG. 13, can be used as a resilient element to function in the same manner of the resilient elements 90*a* through 90*h*, without departing from the spirit and scope of the invention. The spring damper 112 includes two capsule-like elements 114 and 116 which are relatively slidable, one over the other, and which form a sealed enclosure for receiving a spring (not shown) and a fluid such as, for example, a hydraulic fluid therein for a damping effect upon movement of the spring. When using the spring damper 112, the cribs, for example, cribs 78*b* and 78*d*, are modified with funnel-shaped openings 118 and 120, respectively, to permit movement of the spring damper during use of the seating structure 30.

Figure 6:
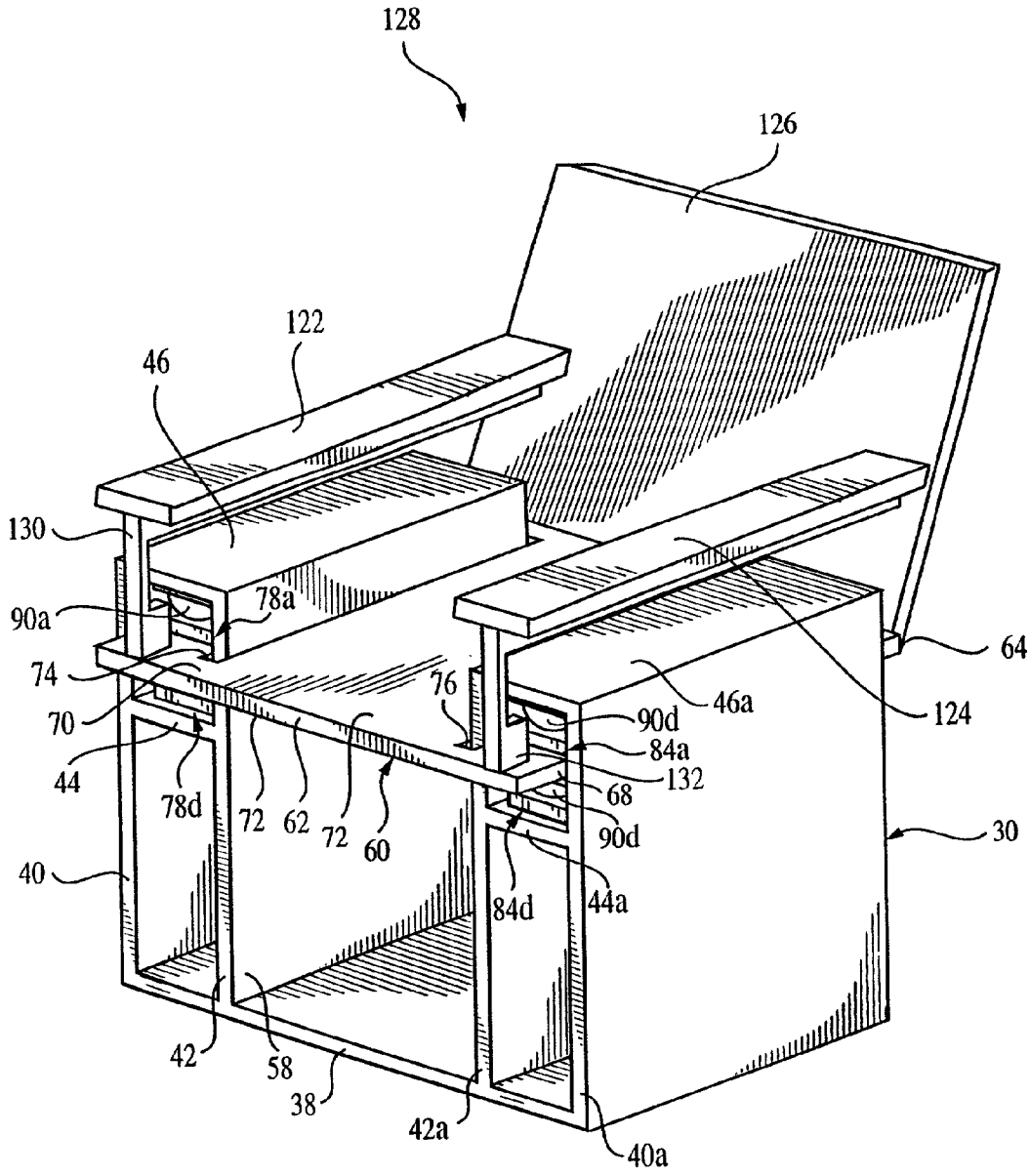
FIG. 6 is a perspective view of a chair which includes the seating structure of FIG. 1, in accordance with certain principles of the invention.

Referring to FIG. 6, a pair of arm rests 122 and 124, and a back 126, are attached to the platform 60 of the seating structure 30 to form a chair 128, which provides a user with the benefits and enhancements described above with respect to the seating structure. In particular, a lower edge of the back 126 is attached to the rear edge 64 of the platform 60. Further, lower portions of a pair of forward struts 130 and 132 are attached, at spaced locations, to the upper surface 70 of the platform 60. Upper portions of the struts 130 and 132 are attached to a forward undersurface of the pair of arm rests 122 and 124, respectively. Rearward portions of the arm rests 122 and 124 are attached to spaced intermediate portions of the back 126.

Figure 7:
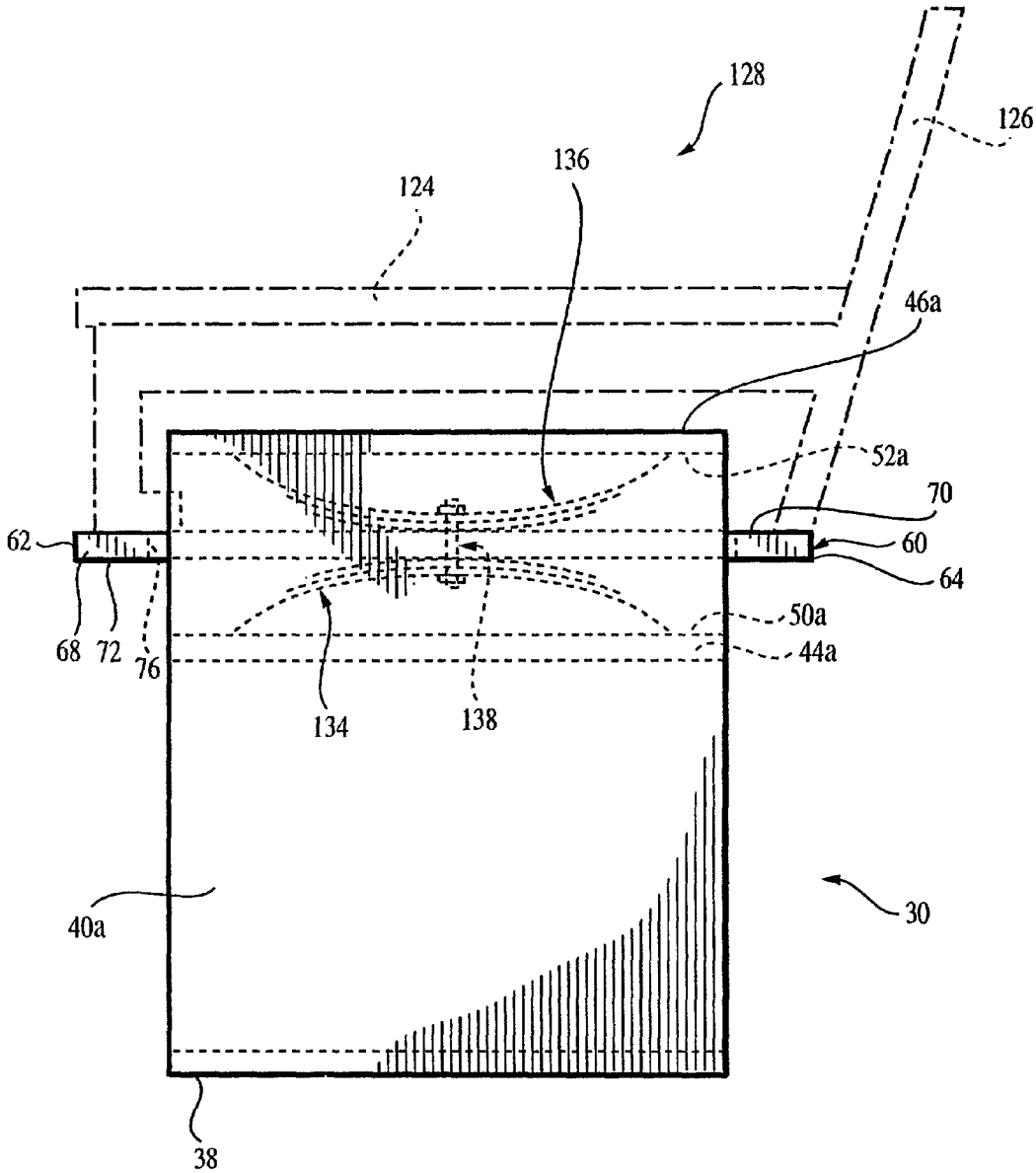
FIG. 7 is a left side view showing a seating structure with a resilient element in the form of a compound leaf spring, and chair components, all in accordance with certain principles of the invention.

Referring to FIG. 7, the seating structure 30, with the arm rests 122 and 124 and the back 126 shown in phantom, includes resilient elements in the form of semielliptic springs 134 and 136. The stacked leaves of the spring 134 are located between the upper surface 50*a* of the shelf 44*a* and the undersurface 72 of the platform 60. The stacked leaves of the spring 136 are located between the upper surface 70 of the platform 60 and the undersurface 52*a* of the enclosure plate 46*a*. A stud 138, threaded at both ends, or a bolt with a head at one end and threaded at the other end, is positioned through aligned openings in the springs 134 and 136, and the platform 60, and, with one or more nuts, facilitates securance of the springs in place as illustrated. With the springs 134 and 136, the seating structure 30 will function in a manner similar to the functioning thereof with the resilient elements 90*a* through 90*h*, as described above, without departing from the spirit and scope of the invention.

It is noted that the springs 134 and 136 could each be mounted in an inverted position without departing from the spirit and scope of the invention.

The seating structure 30, as described above, includes the platform 60 having the seating portion 92, which encounters no impediments or obstacles therebeneath at any time, including during use thereof by a user. The seating portion 92 of the platform 60 is supported at locations which are isolated from and independent of the seating portion, that is, at the non-seating portions 94*a* and 94*b*. By use of the resilient elements 90*a* through 90*h* at the non-seating portions 94*a* and 94*b* of the platform 60, the seating structure 30 provides the user with a buoyant and floating experience which is relaxing and enjoyable, regardless of whether the user is sitting or rocking.

As noted above, the platform 60 is formed with the front edge 62, the rear edge 64 and the side edges 66 and 68. Referring to FIGS. 2 through 5, the resilient elements 90*a* through 90*h* are located such that at least portions of each of the resilient elements are in engagement with a respective prescribed portion of the undersurface 72 and the upper surface 70, where the prescribed portions are exclusive and independent of the seating portion 92 of the platform 60, and exclusive and spaced from the edges 62, 64, 66 and 68 of the platform. In this manner, a first resilient element, such as, for example, the resilient element 90*a*, is in engagement with a prescribed portion of the undersurface 72 of the platform 60, where the prescribed portion is inboard of any of the edges 62, 64, 66 and 68 of the platform, and thereby spaced from the edges. Further, a second resilient element, such as, for example, the resilient element 90*e*, is in engagement with a prescribed portion of the upper surface 70 of the platform 60, where the prescribed portion is inboard of any of the edges 62, 64, 66 and 68 of the platform, and thereby spaced from the edges.

It is noted that, while at least portions of the resilient elements 90*a* through 90*h* are in engagement with the respective portions of the undersurface 72 and the upper surface 70 of the platform 60 and spaced from the edges 62, 64, 66 and 68 of the platform as described above, other portions of the resilient elements could extend to, and be in engagement with, the edges without departing from the spirit and scope of the invention.

In general, the above-identified embodiments are not to be construed as limiting the breadth of the present invention. Modifications, and other alternative constructions, will be apparent which are within the spirit and scope of the invention as defined in the appended claims.

What is claimed is:

1. A seating structure, which comprises:

a frame;

a platform formed with a seating portion;

the platform formed with a upper surface on one side thereof;

the platform formed with an undersurface on another side thereof opposite the one side;

the seating portion formed with a seating surface, on the one side of the platform, on which a user of the seating structure will sit;

the platform formed with edges which extend between the upper surface and the undersurface; and means for supporting the platform in a floating relation to the frame independently of engagement with the seating portion; which includes:

a first resilient element having at least portions in engagement with a first prescribed portion of the undersurface of the platform independently of the seating portion of the platform and spaced from any edges of the platform; and a second resilient element having at least portions in engagement with a second prescribed portion of the upper surface of the platform independently of the seating portion of the platform and spaced from any edges of the platform.

2. The seating structure as set forth in claim 1, which further comprises:

the first prescribed portion of the undersurface of the platform being in alignment with the second prescribed portion of the upper surface of the platform.

3. The seating structure as set forth in claim 1, which further comprises:

the first resilient element being in engagement with the first prescribed portion of the undersurface of the platform; and the second resilient element being in engagement with the second prescribed portion of the upper surface of the platform.

4. The seating structure as set forth in claim 1, wherein the first resilient element and the second resilient element are selected from the group consisting of a pressurized shell, a full mass of compressible material, a coil spring, at least one leaf spring and a spring damper.

5. A seating structure, which comprises:

a frame;

a platform formed with a seating portion;

the platform formed with an undersurface on one side thereof and edges extending therefrom and having a first plurality of spaced prescribed portions which are spaced from the edges of the platform;

the platform formed with an upper surface on another side thereof opposite the one side and having a second plurality of spaced prescribed portions which are aligned with respective ones of, and correspond in number to, the first plurality of spaced prescribed portions;

the seating portion formed with a seating surface, on the another side of the platform, on which a user of the seating structure will sit;

means for supporting the platform in a floating relation to the frame independently of engagement with the seating portion, which includes:

each of a first plurality of resilient elements having at least portions in engagement with a respective one of the first plurality of prescribed portions of the undersurface of the platform independently of the seating portion and spaced from the edges of the platform; and each of a second plurality of resilient elements having at least portions in engagement with a respective one of the second plurality of prescribed portions of the upper surface of the platform independently of the seating portion and spaced from the edges of the platform.

6. The seating structure as set forth in claim 5, which further comprises:

the first plurality of resilient elements including four resilient elements;

the second plurality of resilient elements including four resilient elements; and each of the four resilient elements of the first plurality being in alignment with respective ones of the four resilient elements of the second plurality.

7. The seating structure as set forth in claim 5, wherein the first plurality of resilient elements and the second plurality of resilient elements are selected from the group consisting of a pressurized shell, a full mass of compressible material, a coil spring, at least one leaf spring and a spring damper.

8. A seating structure, which comprises:

a frame;

a platform in relative movable assembly with the frame;

the platform formed with a seating portion on which a person may sit, and a non-seating portion;

a resilient element located between a portion of the frame and a portion of the non-seating portion of the platform to provide floating assembly of the seating portion of the platform relative to the frame;

the frame including a panel having a prescribed cross-sectional configuration with prescribed dimensions;

the platform formed with a slot located about the panel of the frame; and the slot of the platform having a cross-sectional configuration generally similar to the prescribed cross-sectional configuration with dimensions greater than the prescribed dimensions to provide for limited movement of the platform relative to the panel.

9. The seating structure as set forth in claim 8, wherein the resilient element is selected from the group consisting of a pressurized shell, a full mass of compressible material, a coil spring, at least one leaf spring and a spring damper.

10. A seating structure, which comprises:

a housing having a compartment with a base surface formed therein;

a platform having a seating portion, located outside of the housing, on which a person may sit, and a non-seating portion;

the platform being in movable assembly with the housing;

the non-seating portion of the platform formed with a facing surface which is located in the compartment of the housing in spaced parallel interfacing relation with the base surface of the compartment to form a cell therebetween;

means for facilitating relative movement between the facing surface of the non-seating portion and the base surface of the compartment while maintaining the parallel interfacing relation therebetween; and means, located in the cell and having spaced portions adjacent the non-seating portion of the platform and the base surface of the compartment, for resiliently supporting the platform relative to the housing.

11. The seating structure as set forth in claim 10, wherein the cell is a first cell and the means for resiliently supporting the platform is a first means located within the first cell, which further comprises:

an upper surface formed by the compartment which is spaced from the base surface;

the non-seating portion of the platform being located between and spaced from the base surface and the upper surface of the compartment to form the first cell between the base surface and the non-seating portion, and to form a second cell between the upper surface of the compartment and the non-seating portion; and second means, located in the second cell and having spaced portions adjacent the non-seating portion of the platform and the upper surface of the compartment, for resiliently supporting the platform relative to the housing in cooperation with the first means.

12. The seating structure as set forth in claim 11, wherein the means for resiliently supporting the platform comprises:

a first resilient element located between a first section of the non-seating portion and a first section of the base surface; and a second resilient element located between a second section of the non-seating portion and the upper surface.

13. The seating structure as set forth in claim 10, wherein the means for resiliently supporting the platform comprises:

an enclosed compliant expandable shell;

a prescribed amount of a pressurized medium within the shell which expands the shell to a prescribed configuration; and the shell being compliant to allow the shell to assume a configuration other than the prescribed configuration when a person sits on the seating portion of the platform.

14. The seating structure as set forth in claim 10, wherein the means for resiliently supporting the platform is selected from the group consisting of a pressurized shell, a full mass of compressible material, a coil spring, at least one leaf spring and a spring damper.

15. A seating structure, which comprises:

a first housing having a first compartment formed therein;

a second housing, spaced from the first housing, having a second compartment formed therein;

a platform having a seating portion on which a person may sit, the seating portion formed with a right-side edge and a left-side edge opposite the right-side edge;

the platform having a first non-seating portion extending from, and joined with, the right-side edge of the seating portion, and a second non-seating portion extending from, and joined with, the left-side edge of the seating portion;

the first non-seating portion of the platform located within the first compartment for movement relative to the first housing;

the second non-seating portion of the platform located within the second compartment for movement relative to the second housing;

the seating portion of the platform located outside of, and between, the first housing and the second housing, and being joined with only the first non-seating portion and the second non-seating portion of the platform;

first means, located in the first compartment, for resiliently supporting the first non-seating portion of the platform relative to the first housing; and second means, located in the second compartment, for resiliently supporting the second non-seating portion of the platform relative to the second housing.

16. The seating structure as set forth in claim 15, which further comprises:

a first cell formed within the first compartment adjacent an undersurface of the first non-seating portion of the platform;

a second cell formed within the first compartment adjacent an upper surface of the first non-seating portion of the platform;

a third cell formed within the second compartment adjacent an undersurface of the second non-seating portion of the platform; and a fourth cell formed within the second compartment adjacent an upper surface of the second non-seating portion of the platform.

17. The seating structure as set forth in claim 16, wherein the first means for resiliently supporting comprises:

a first pair of spaced resilient elements located in the first cell; and a second pair of spaced resilient elements located in the second cell in alignment with respective ones of the first pair of spaced resilient elements; and wherein the second means for resiliently supporting comprises:

a third pair of spaced resilient elements located in the third cell; and a fourth pair of spaced resilient elements located in the fourth cell in alignment with respective ones of the third pair of spaced resilient elements.

18. The seating structure as set forth in claim 15, which further comprises:

a base having a first section attached to a lower end of the first housing;

the base having a second section, spaced from the first section thereof, attached to a lower end of the second housing; and the base having a middle section between the first section and the second section thereof extending between the first housing and the second housing.

19. The seating structure as set forth in claim 15, which further comprises:

the first housing including a panel having a prescribed cross-sectional configuration with prescribed dimensions;

the platform formed with a slot located about the panel of the first housing; and the slot of the platform having a cross-sectional configuration generally similar to the prescribed cross-sectional configuration with dimensions greater than the prescribed dimensions to provide for limited movement of the platform relative to the panel.

20. The seating structure as set forth in claim 19, wherein the slot is a first slot, and which further comprises:

the second housing including a panel formed in the prescribed cross-sectional configuration with the prescribed dimensions;

the platform formed with a second slot, spaced from the first slot and located about the panel of the second housing; and the second slot of the platform formed with a cross-sectional configuration which is the same as the cross-sectional configuration of the first slot, and with dimensions which are the same as the dimensions of the first slot.

21. The seating structure as set forth in claim 19, which further comprises:

a plurality of cribs fixedly located within each of the first, second, third and fourth cells; and each of the resilient elements of the first, second, third and fourth pairs of spaced resilient elements having a first portion thereof located within a respective one of the plurality of cribs, and having a second portion thereof, spaced from the first portion, located within a respective one of the plurality of cribs, to preclude lateral movement of the first and second portions of each of the plurality of resilient elements relative to the respective cribs of the plurality of cribs.

22. The seating structure as set forth in claim 19, wherein the panel is a first panel having a first prescribed cross-sectional configuration with first prescribed dimensions, the slot of the platform is a first slot located about the first panel, the first slot has a cross-sectional configuration generally similar to the first prescribed cross-sectional configuration with dimensions greater than the first prescribed dimensions, which further comprises:

the second housing including a second panel having a second prescribed cross-sectional configuration with second prescribed dimensions;

the platform formed with a second slot, spaced from the first slot, located about the second panel of the second housing; and the second slot of the platform having a cross-sectional configuration generally similar to the second prescribed cross-sectional configuration with dimensions greater than the second prescribed dimensions to provide for limited movement of the platform relative to the second panel.

23. The seating structure as set forth in claim 22, which further comprises:

the first slot defining a plane at which the first non-seating portion of the platform is joined with the seating portion of the platform; and the second slot defining a plane at which the second non-seating portion of the platform is joined with the seating portion of the platform.

24. The seating structure as set forth in claim 15, wherein the first means for resiliently supporting and the second means for resiliently supporting are selected from the group consisting of a pressurized shell, a full mass of compressible material, a coil spring, at least one leaf spring and a spring damper.

25. A seating structure, which comprises:

a frame;

a platform having an undersurface and an upper surface with edges extending therebetween;

the platform having spaced portions mounted on the frame for movement relative to the frame;

each of the spaced portions of the platform having an undersurface formed by portions of the undersurface of the platform;

a first set of resilient elements having at least portions in engagement with the undersurface of the spaced portions of the platform, and spaced from the edges of the platform, to buoyantly support the platform against any external forces exerted on the platform in a direction outward from the undersurface of the spaced portions;

the platform formed with a seating portion which is formed with a seating surface on the upper surface of the platform, and which extends between the spaced portions of the platform free of engagement with any of the resilient elements of the set;

the seating surface being the surface on which a user of the seating structure will sit;

each of the spaced portions of the platform having an upper surface formed by portions of the upper surface of the platform; and a second set of resilient elements having at least portions in engagement with the upper surface of the spaced portions of the platform, and spaced from the edges of the platform, to buoyantly support the platform against any external forces exerted on the platform in a direction outward from the upper surface of the spaced portions.

26. The seating structure as set forth in claim 25, which further comprises:

the first set of resilient elements positioned at spaced locations adjacent the undersurface of the platform;

the second set of resilient elements positioned at spaced locations adjacent the upper surface of the platform; and the spaced locations of the first set of resilient elements being aligned with the spaced locations of the second set of resilient elements.

27. The seating structure as set forth in claim 25, which further comprises:

the first set of resilient elements being comprised of four resilient elements; and the second set of resilient elements being comprised of four resilient elements.

28. The seating structure as set forth in claim 25, which further comprises;

the platform being formed with a front edge, a rear edge, a right-side edge and a left-side edge; and means for allowing the platform, and thereby the seating portion, to be moved in an arcing direction along any portion of the front edge, the rear edge, the right-side edge and the left-side edge of the platform.

29. The seating structure as set forth in claim 25, wherein the first set of resilient elements and the second set of resilient elements are selected from the group consisting of a pressurized shell, a full mass of compressible material, a coil spring, at least one leaf spring and a spring damper.

* * * * *